US010385291B2

(12) United States Patent
Meier et al.

(10) Patent No.: US 10,385,291 B2
(45) Date of Patent: Aug. 20, 2019

(54) LIQUID SURFACTANT COMPOSITIONS AND ASSOCIATED METHODS

(71) Applicants: Henkel AG & Co. KGaA, Duesseldorf (DE); Henkel IP & Holding GmbH, Duesseldorf (DE)

(72) Inventors: Frank Meier, Duesseldorf (DE); Bin Lin, Scottsdale, AZ (US); Natalie Mast, Phoenix, AZ (US); Martina Seiler, Duisburg (DE); Pamela Lam, Scottsdale, AZ (US); John O. Hudson, Scottsdale, AZ (US)

(73) Assignees: Henkel AG & Co. KGaA, Duesseldorf (DE); Henkel IP & Holding GmbH, Duesseldorf (DE)

( * ) Notice: Subject to any disclaimer, the term of this patent is extended or adjusted under 35 U.S.C. 154(b) by 0 days.

(21) Appl. No.: 15/389,408

(22) Filed: Dec. 22, 2016

(65) Prior Publication Data

US 2018/0179467 A1 Jun. 28, 2018

(51) Int. Cl.

| | |
|---|---|
| ***C11D 1/00*** | (2006.01) |
| ***C11D 1/83*** | (2006.01) |
| ***C11D 1/29*** | (2006.01) |
| ***C11D 1/22*** | (2006.01) |
| ***C11D 11/00*** | (2006.01) |

(52) U.S. Cl.

CPC ..... *C11D 1/83* (2013.01); *C11D 1/22* (2013.01); *C11D 1/29* (2013.01); *C11D 11/0017* (2013.01)

(58) Field of Classification Search

None

See application file for complete search history.

(56) References Cited

U.S. PATENT DOCUMENTS

| | | | | |
|---|---|---|---|---|
| 4,747,977 | A | 5/1988 | Whitehead et al. | |
| 5,419,853 | A | 5/1995 | Kemen | |
| 5,789,372 | A | 8/1998 | Fabry | |
| 5,863,878 | A | 1/1999 | Carr et al. | |
| 6,387,868 | B1 | 5/2002 | Uno et al. | |
| 6,881,359 | B2 | 4/2005 | Leeners et al. | |
| 2004/0102349 | A1 | 5/2004 | Breves et al. | |
| 2004/0141937 | A1 | 7/2004 | Loffler et al. | |
| 2007/0167345 | A1 | 7/2007 | Soldanski et al. | |
| 2014/0227764 | A1 | 8/2014 | Hellmuth et al. | |
| 2016/0362644 | A1* | 12/2016 | Meine | C11D 3/3707 |
| 2017/0292086 | A1* | 10/2017 | Seiler | C11D 1/22 |

FOREIGN PATENT DOCUMENTS

| | | | |
|---|---|---|---|
| CA | 2243007 | A1 | 2/1999 |
| EP | 1305432 | B1 | 9/2010 |
| GB | 1296839 | A | 11/1972 |
| KR | 10-2016-0034969 | A | 3/2016 |
| WO | WO 92/06165 | A1 | 4/1992 |
| WO | WO 96/23873 | A1 | 8/1996 |
| WO | WO 96/29397 | A1 | 9/1996 |
| WO | WO 97/03160 | A1 | 1/1997 |
| WO | WO 97/14804 | A1 | 4/1997 |
| WO | WO 97/25397 | A1 | 7/1997 |
| WO | WO 98/12307 | A1 | 3/1998 |
| WO | WO 99/64619 | A2 | 12/1999 |
| WO | WO 00/60060 | A2 | 10/2000 |
| WO | WO 00/60063 | A1 | 10/2000 |
| WO | WO 01/46700 | A2 | 6/2001 |
| WO | WO 01/66712 | A2 | 9/2001 |
| WO | WO 02/10356 | A2 | 2/2002 |
| WO | WO 02/99091 | A2 | 12/2002 |
| WO | WO 2013/060621 | A1 | 5/2013 |

OTHER PUBLICATIONS

Altschul et al.; "Basic local alignment search tool"; Journal of Molecular Biology; (Oct. 5, 1990); pp. 403-410; vol. 215, Issue 3; < doi: 10.1016/S022-2836(05)80360-2 >.

Altschul et al.; "Gapped BLAST and PSI-BLAST: a new generation of protein database search programs"; Nucleic Acids Research; (1997); pp. 3389-3402; vol. 25, No. 17; Oxford University Press.

BARRETT; Nomenclature Committee of the International Union of Biochemistry and Molecular Biology (NC-IUBMB); "Enzyme Nomenclature. Recommendations 1992 Supplement 2: corrections and additions"; European Journal of Biochemistry; (1995); 6 pages; vol. 232; Academic Press.

BARRETT; Nomenclature Committee of the International Union of Biochemistry and Molecular Biology (NC-IUBMB); "Enzyme Nomenclature. Recommendations 1992 Supplement 3: corrections and additions"; European Journal of Biochemistry; (1996); 5 pages; vol. 237; Academic Press.

BARRETT; Nomenclature Committee of the International Union of Biochemistry and Molecular Biology (NC-IUBMB); "Enzyme Nomenclature. Recommendations 1992 Supplement 4: corrections and additions"; European Journal of Biochemistry; (1997); 6 pages; vol. 250; Academic Press.

Burnley et al.; "Modified OXO Alcohol Derivatives for Personal Care"; In: World Surfactant Congress and Business Convention (CESIO); 2004; 6th World Surfactants Congress; Berlin, Germany; (Jun. 20-23, 2004); 12 pages.

Chenna et al.; "Multiple sequence alignment with the Clustal series of programs"; Nucleic Acids Research; (2003); pp. 3497-3500; vol. 31, No. 13; < doi: 10.1093/nar/gkg500 >.

CONDEA; "Dr. Z Presents All About Fatty Alcohols"; Research Gate; (2000); 43 pages; CONDEA.

(Continued)

*Primary Examiner* — Necholus Ogden, Jr.

(74) *Attorney, Agent, or Firm* — Thorpe North & Western, LLP; David W. Osborne

(57) ABSTRACT

A liquid surfactant composition can include a $C_9$-$C_{20}$ alkylbenzene sulfonate, a nonionic surfactant, and an anionic surfactant. The anionic surfactant can include a first alcohol ether sulfate (AES) surfactant and a second AES surfactant. The first AES surfactant can have a molecular formula of $R^1$—O—($CH_2$—$CH_2$—O)$_m$—$SO_3M$, wherein $R^1$ represents a $C_{10}$-$C_{20}$ alkyl group, m represents a number from 6 to 8, and M represents a monovalent cation. The second AES surfactant can have a molecular formula of $R^2$—O—($CH_2$—$CH_2$—O)$_n$—$SO_3M'$, wherein $R^2$ represents a $C_{10}$-$C_{20}$ alkyl group, n is 2 or 3, and M' represents a monovalent cation. The first AES surfactant and the second AES surfactant can be present in the liquid surfactant composition at a weight ratio to provide the liquid surfactant composition with a fresh viscosity from about 350 centipoise (cPS) to about 550 cps.

20 Claims, No Drawings

(56) References Cited

OTHER PUBLICATIONS

Gornall et al.; "Determination of Serum Proteins by Means of the Biuret Reaction"; The Journal of Biological Chemistry; (1948); pp. 751-766; vol. 177.

Nomenclature Committee of The International Union of Biochemistry and Molecutlar Biology (NC-IUMB); "Enzyme Nomenclature. Recommendations 1992 Supplement: correction and additions"; European Journal of Biochemistry; (1994); 5 pages; vol. 223; Academic Press.

Notredame et al.; "T-Coffee: A Novel Method for Fast and Accurate Multiple Sequence Alignment"; Journal of Molecular Biology; (2000); pp. 205-217; vol. 302; < doi: 10.1006/jmbi.2000.4042 >.

NOWECK; "Production, Technologies and Applications of Fatty Alcohols"; In: Lecture at the $4^{th}$ Workshop on Fats and Oils as Renewable Feedstock for the Chemical Industry; (Mar. 20-22, 2011); 9 pages; Karlsruhe, Germany.

Tipton et al.; Nomenclature Committee of the International Union of Biochemistry and Molecular Biology (NC-IUBMB); "Enzyme Supplement 5"; European Journal of Biochemistry; (1999); pp. 610-650; vol. 264; Academic Press.

Van Raay et al.; "Zur bestimmung der proteolytischen aktivität in enzymkonzentraken und enzymhaltigen wasch-,spül-, und reinigungsmitteln"; Tenside Detergents Journal; (May 1970); pp. 125-132; vol. 7, Issue 3; (The Determination of Proteolytic Activity in Enzyme Concentrates and Enzyme Containing Detergents); [abstract].

Wikipedia; "Pierce Biotechnology"; (Nov. 22, 2016); 2 pages; [retrieved on Jan. 22, 2018] Retrieved from < URL: https://en.wikipedia.org/wiki/Pierce_Biotechnology >.

International Search Report dated Apr. 16, 2018, in International Application No. PCT/US2017/067661, filed Dec. 20, 2017; 5 pages.

* cited by examiner

LIQUID SURFACTANT COMPOSITIONS AND ASSOCIATED METHODS

BACKGROUND

Often, liquid detergents are provided in a reservoir in a quantity sufficient for multiple wash loads. In order to perform a wash cycle, a user takes a quantity of liquid detergent necessary for one wash cycle from the reservoir and transfers the quantity of liquid detergent to a washing machine. This can be done by transferring the liquid detergent into a dispensing compartment of the washing machine or by transferring the liquid detergent directly into a drum of the washing machine. Accordingly, in many cases liquid detergents can be provided with a measuring cup to facilitate transfer of an appropriate quantity of liquid detergent to the washing machine.

Liquid detergents typically have a suitable rheology that allows the detergent to be easily dispensed from the reservoir. Further, liquid detergents can typically have good stability over a variety of temperatures to facilitate transportation and storage in various climates, as well as stability during wash cycles performed at various temperatures.

DESCRIPTION OF EMBODIMENTS

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this written description, the singular forms "a," "an" and "the" include express support for plural referents unless the context clearly dictates otherwise. Thus, for example, reference to "a polymer" can include a plurality of such polymers.

In this application, "comprises," "comprising," "containing" and "having" and the like can have the meaning ascribed to them in U.S. patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. patent law. "Consisting essentially of" or "consists essentially of" have the meaning generally ascribed to them by U.S. patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," in this written description it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms." Furthermore, it is to be understood that in this written description support for actual numerical values is provided even when the term "about" is used therewith. For example, the recitation of "about" 30 should be construed as not only providing support for values a little above and a little below 30, but also for the actual numerical value of 30 as well.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference in this application may be made to compositions, systems, or methods that provide "improved" or "enhanced" performance. It is to be understood that unless otherwise stated, such "improvement" or "enhancement" is a measure of a benefit obtained based on a comparison to compositions, systems or methods in the prior art. Furthermore, it is to be understood that the degree of improved or enhanced performance may vary between disclosed embodiments and that no equality or consistency in the amount, degree, or realization of improvement or enhancement is to be assumed as universally applicable.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Example Embodiments

An initial overview of invention embodiments is provided below and specific embodiments are then described in further detail. This initial summary is intended to aid readers in understanding the technological concepts more quickly, but is not intended to identify key or essential features thereof, nor is it intended to limit the scope of the claimed subject matter.

In some embodiments, liquid surfactant compositions can include a variety of components. For example, a liquid surfactant composition can include a $C_9$-$C_{20}$ alkylbenzene sulfonate, a nonionic surfactant, and an anionic surfactant. The anionic surfactant can include a first alcohol ether sulfate or alcohol ethoxylsulfate (AES) surfactant and a second AES surfactant. The first AES surfactant can have a molecular formula of $R^1$—O—$(CH_2$—$CH_2$—$O)_m$—$SO_3M$, wherein $R^1$ represents a $C_{10}$-$C_{20}$ alkyl group, m is a number from 6 to 8, and M represents a monovalent cation. The second AES surfactant can have a molecular formula of $R^2$—O—$(CH_2$—$CH_2$—$O)_n$—$SO_3M'$, wherein $R^2$ represents a $C_{10}$-$C_{20}$ alkyl group, n is 2 or 3, and M' represents a monovalent cation. The first AES surfactant and the second AES surfactant can be present in the liquid surfactant composition at a weight ratio to provide the liquid surfactant composition with a fresh viscosity from about 350 centipoise (cps) to about 550 cps. "Fresh viscosity," as used herein, refers to the viscosity of the liquid surfactant composition at the time the liquid surfactant composition is ready for packaging and/or quality control testing prior to distribution. In some other examples, the liquid surfactant composition can also be included in a liquid surfactant system where the liquid surfactant composition can be enclosed or contained within a container.

In other embodiments, methods of manufacturing liquid surfactant compositions are also provided. Such methods can include providing an aqueous vehicle, combining a $C_9$-$C_{20}$ alkylbenzene sulfonate with the aqueous vehicle, combining a nonionic surfactant with the aqueous vehicle, and combining an anionic surfactant with the aqueous vehicle. The anionic surfactant can include a first AES surfactant and a second AES surfactant. The first AES surfactant can have a molecular formula of $R^1$—O—$(CH_2$—$CH_2$—$O)_m$—$SO_3M$, wherein $R^1$ represents a $C_{10}$-$C_{20}$ alkyl group, m represents a number from 6 to 8, and M represents a monovalent cation. The second AES surfactant can have a molecular formula of $R^2$—O—$(CH_2$—$CH_2$—$O)_n$—$SO_3M'$, wherein $R^2$ represents a $C_{10}$-$C_{20}$ alkyl group, n is 2 or 3, and M' represents a monovalent cation. The first AES surfactant and the second AES surfactant can be present in the liquid surfactant composition at a weight ratio to provide the liquid surfactant composition with a fresh viscosity from about 350 cps to about 550 cps.

With the foregoing in mind, it is noted that when discussing liquid surfactant compositions, methods of manufacturing liquid surfactant compositions, and liquid surfactant systems, each discussion can be considered applicable to each example, whether or not they are explicitly discussed in the context of that example. Thus, for example, in discussing details about the liquid surfactant compositions per se, such discussion also refers to the method of manufacturing the liquid surfactant composition and the liquid surfactant system described herein, and vice versa.

In additional embodiments, a liquid surfactant composition can include a $C_9$-$C_{20}$ alkylbenzene sulfonate. In some examples, the alkylbenzene sulfonate can be a $C_{10}$-$C_{15}$ alkylbenzene sulfonate. In some examples, the alkylbenzene sulfonate can be a $C_{10}$-$C_{13}$ alkylbenzene sulfonate. The alkyl group of the alkylbenzene sulfonate can be linear, branched, or can include a distribution of both linear and branched products. In some examples, the alkyl group of the alkylbenzene sulfonate can be unsubstituted. In some specific examples, the alkylbenzene sulfonate can be a linear alkylbenzene sulfonate. In some other examples, the alkylbenzene sulfonate can be a branched alkylbenzene sulfonate.

The alkylbenzene sulfonate can be present in the liquid surfactant composition in an amount from about 1 wt % to about 10 wt %, or from about 2 wt % to about 8 wt % or from about 2 wt % to about 6 wt %. It is noted that these weight percentages are calculated with $Na^+$ as the counterion. Thus, where it is desirable to use a different monovalent counterion, the appropriate weight percentage can be calculated by first converting the alkylbenzene sulfonate to include $Na^+$ as the counterion.

In some specific examples, the alkyl benzene sulfonate can have a molecular formula of:

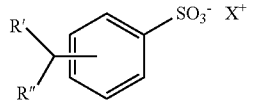

Where this is the case, R' and R" can represent linear or branched alkyl groups. In some examples, R' and R" can jointly have from 8 to 19 carbon (C) atoms, or from 9 to 14 carbon atoms, or from 9 to 12 carbon atoms. $X^+$ can represent a monovalent cation. Non-limiting examples of suitable monovalent cations can include $Na^+$, $K^+$, $HO—CH_2CH_2NH_3^+$, $(HO—CH_2CH_2)_3NH^+$, the like, or combinations thereof. In some specific examples, the alkyl benzene sulfonate can have a molecular formula of:

(a-1)

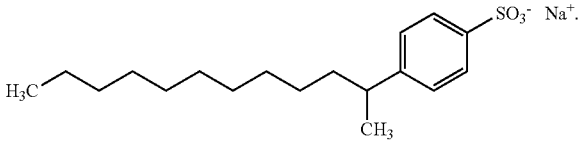

The liquid surfactant compositions can also include a nonionic surfactant. Any suitable nonionic surfactant can be used. In some examples, the nonionic surfactant can be a fatty alcohol based surfactant. Fatty alcohols can be produced from a variety of feedstocks and processes. For example, fatty alcohols can be produced from natural raw materials (i.e. oleochemicals), such as fats and/or oils of plant or animal origin, or wax esters from sources such as whale oil or the jojoba plant. Natural fatty alcohols can be produced from natural sources by a variety of processes, such as reduction of methyl esters with hydrogen at high pressure in the presence of a catalyst, such as copper chromite, aluminum oxide, or others. Oleochemical sources can typically produce only even numbered carbon chains with essentially no branching.

In addition to oleochemical sources, fatty alcohols can also be produced from petrochemical sources using a variety of different methods. One such method is known as the Ziegler alcohol process. Ziegler-based fatty alcohols are typically produced by the oxidation of trialkyl aluminum alkoxylates, followed by fatty alcohol chain growth and subsequent hydrolysis of the desired fatty alcohol. This process typically produces only even numbered carbon chains with minimal to no branching.

Another method of producing fatty alcohols from petrochemical sources is known as the oxo-process (or hydroformylation). This method includes the reaction of olefins with a $H_2$/CO gas mixture in the presence of a suitable catalyst, such as a cobalt compound. The reaction occurs in two parts. The first part is the preparation of an aldehyde. It is noted that two different aldehyde compounds can be produced in this process. One of the aldehyde compounds can be linear, while the other can include a methyl branch. In the second part of the reaction, the aldehyde can be reduced to a fatty alcohol. The oxo-process can produce fatty alcohols having both even and odd numbered carbon chains and can produce branched fatty alcohols. In some examples, oxo-based fatty alcohols can include a distribution of from about 50% to about 60% branched fatty alcohols.

A modified oxo-alcohol process (Shell's Higher Olefin Process) can also be used. In this process the basic oxo-alcohol process can be followed, but a different catalyst, such as a cobalt carbonyl/phosphine complex, can be used. In the modified oxo-alcohol process, fatty alcohols can be obtained directly from olefins due to the greater hydrogenating activity of the catalyst. As such, the aldehyde hydrogenation step is unnecessary. This can improve the overall linearity of the fatty alcohol product such that the distribution of branched fatty alcohols can typically be from about 10% to about 20%.

As will be appreciated by one skilled in the art, a number of other processes can also be used to produce fatty alcohols from oleochemicals and/or petrochemicals. The processes described above are merely used as non-limiting examples of processes that can be used to prepare fatty alcohols. Where fatty alcohol based surfactants are used in the liquid surfactant compositions disclosed herein, any suitable process can be used to prepare fatty alcohol based surfactants, unless otherwise specified.

Therefore, in some cases, the nonionic surfactant can be derived from an oleochemical source. In some additional examples, the nonionic surfactant can be derived from a petrochemical source. Where the nonionic surfactant is derived from a petrochemical source, the nonionic surfactant can be produced via any suitable process, such as the Ziegler process, oxo-alcohol process, modified oxo-alcohol process, or other suitable process.

The nonionic surfactant can be present in the liquid surfactant composition in various amounts. In one specific example, the nonionic surfactant can be present in the liquid surfactant composition in an amount from about 1 wt % to about 10 wt %. In other examples, the nonionic surfactant can be present in the liquid surfactant composition in an amount from about 2 wt % to about 8 wt % or from about 2 wt % to about 6 wt %.

In some specific examples, the nonionic surfactant can have a molecular formula of $R^3$—O-$(AO)_q$—H. Where this is the case, $R^3$ can represent a linear or branched, substituted or unsubstituted, alkyl, aryl, or alkylaryl group. In some examples, $R^3$ can include a decyl, undecyl, dodecyl, tridecyl, tetradecyl, pentadecyl, hexadecyl, heptadecyl, octadecyl, nonadecyl, or eicosyl group, or combinations thereof. In some examples, $R^3$ can represent a $C_{10}$-$C_{20}$ alkyl group. In yet other examples, $R^3$ can represent a $C_{12}$-$C_{18}$ alkyl group. It is noted that where $R^3$ is designated as being an alkyl group within a specific range, such as a $C_{12}$-$C_{18}$ alkyl group, it is meant that less than 5%, less than 2%, or less than 1% of the alkyl groups of $R^3$ fall outside of the designated range. In further detail, in some examples $R^3$ can be a $C_{10}$-$C_{15}$ alkyl group. In some other examples, $R^3$ can be a $C_{14}$-$C_{20}$ alkyl group. In some examples, $R^3$ can include about 1% or less of alkyl groups having a chain length of $C_{13}$ or less. In some examples, $R^3$ can include about 1% or less of alkyl groups having a chain length of $C_{16}$ or greater. In some specific examples, $R^3$ can include at least 85%, at least 90%, or at least 95% $C_{12}$-$C_{13}$ alkyl groups. In some specific examples, $R^3$ can include at least 85%, at least 90%, or at least 95% $C_{13}$-$C_{14}$ alkyl groups. In some specific examples, $R^3$ can include at least 85%, at least 90%, or at least 95% $C_{14}$-$C_{15}$ alkyl groups. In some specific examples, $R^3$ can include at least 85%, at least 90%, or at least 95% $C_{15}$-$C_{16}$ alkyl groups.

The AO group of the nonionic surfactant can represent an ethylene oxide or propylene oxide group. In some examples, the AO group of the nonionic surfactant can be ethylene oxide. In some examples, AO can be propylene oxide. In some other examples, the nonionic surfactant can include a distribution of compounds where AO is ethylene oxide and a distribution of compounds where AO is propylene oxide.

The variable q for the nonionic surfactant can be a number from about 1 to about 20. The variable q can represent the average number of moles of AO relative to the number of moles of $R^3$ or can represent the predominant number of moles of AO relative to the number of moles of $R^3$. In some examples, q can be a number from about 2 to about 8 (i.e. any of 2, 3, 4, 5, 6, 7, or 8). In some examples, q can be from about 6 to about 8. In some further examples, q can be from about 6 to about 7. In additional examples, q can be from about 7 to about 8. In some specific examples, q can be about 6. In other specific examples, q can be about 7. In yet other specific examples, q can be about 8.

In some examples, the alkyl chain length and moles of AO can be adjusted to achieve a hydrophilic-lipophilic balance (HLB) range for the nonionic surfactant from about 10.0 to about 14.0. In yet other examples, the nonionic surfactant can have an HLB range from about 11.0 to about 12.5.

Further still, in some examples, the nonionic surfactant can be a modified oxo-alcohol-based surfactant. In other words, the nonionic surfactant can be prepared via the modified oxo-alcohol process. Further, in some examples, the nonionic surfactant can include a distribution of compounds with alkyl groups having odd numbered carbon chains. In such examples, the nonionic surfactant can have a distribution of at least 10%, at least 20%, at least 30%, or at least 40% $C_{11}$, $C_{13}$, $C_{15}$, $C_{17}$, or $C_{19}$ alkyl groups, or a combination thereof. Further, in some examples, the nonionic surfactant can have a distribution of branched alkyl groups. In such examples, the nonionic surfactant can include a distribution of at least 10% or at least 15% branched alkyl groups. In some examples, the nonionic surfactant can include a distribution of about 10% to about 25% branched alkyl groups.

The liquid surfactant composition can also include an anionic surfactant. The anionic surfactant can be present in an amount from about 1 wt % to about 25 wt %. In some specific examples, the anionic surfactant can be present in the liquid surfactant composition in an amount from about 12 wt % to about 25 wt %, or from about 15 wt % to about 22 wt %.

As previously described, the anionic surfactant can include a first AES surfactant and a second AES surfactant in a ratio to provide the final formulation of the liquid surfactant composition with a suitable fresh viscosity. The viscosity of the liquid surfactant composition can be an important feature of the composition. For example, the presence of anionic and other surfactants can increase the cleaning performance of the liquid surfactant composition. However, increasing amounts of surfactants can typically increase the viscosity of the composition. In some cases the increased viscosity can result in reduced transfer volumes due to increased adherence of the composition to a measuring cup or other reservoir used to transfer the composition to the washing machine. Consequently, consumers can incorrectly perceive that compositions of relatively low viscosity have a higher cleaning performance, due to a more complete emptying of composition from the measuring cup or other reservoir into the washing machine. Therefore, careful control of the viscosity can provide a liquid surfactant composition with both good cleaning performance and good transfer from the measuring cup or other reservoir to the washing machine. In some examples, the fresh viscosity of the liquid surfactant composition can be from about 350 cps to about 550 cps. In other examples, the fresh viscosity can be from about 375 cps to about 425 cps. However, in some cases, the viscosity of the formulation can change over time. Therefore, the liquid surfactant composition can also have a suitable storage viscosity. For example, the liquid surfactant composition can have a 1 week storage viscosity at 25° Celsius of from about 340 cps to about 450 cps, or from about 340 cps to about 400 cps.

Further, in some examples, the liquid surfactant composition can be free of or substantially free of a polymeric rheology modifier or polymeric thickening agent. A polymeric rheology modifier can be any high molecular weight polymer that is typically added to a liquid surfactant composition to control or adjust the viscosity of the composition to within a specified range, such as the viscosity ranges described above. A polymeric rheology modifier can be understood to be a polymer compound having an average molecular weight (weight average $M_w$) of more than 1500 g/mol. In some examples, the polymeric rheology modifier can include a polyacrylate. Non-limiting examples of polyacrylates can include polyacrylate or polymethacrylate thickeners, such as, for example, high-molecular-weight homopolymers of acrylic acid (INCI name of carbomer according to the "International Dictionary of Cosmetic Ingredients" of the "The Cosmetic, Toiletry, and Fragrance Association (CTFA)") that are cross-linked with a polyalkenyl polyether, such as an allyl ether of saccharose, pentaerythrite, or propylene. These homopolymers can also be characterized as carboxyvinyl polymers. Such polyacrylic acids can be obtained, for example, from 3V Sigma under the trade name Polygel®, e.g. Polygel DA, and from Noveon under the trade name Carbopol®, e.g. Carbopol 940 (approximate molecular weight 4,000,000), Carbopol 941 (approximate molecular weight 1,250,000), or Carbopol 934 (approximate molecular weight 3,000,000). The polymeric rheology modifier can also include copolymers of two or more monomers from the group of acrylic acid, methacrylic acid, and its monovalent esters (INCI: Acrylates Copolymer), which can be formed with $C_{1-4}$ alkanols. Such examples can include the copolymers of methacrylic acid, butylacrylate, and methyl methacrylate (CAS designation according to the Chemical Abstracts Service: 25035-69-2) or of butylacrylate and methyl methacrylate (CAS 25852-37-3), and those that can be obtained, for example, from Rohm & Haas under the trade names Aculyn® and Acusol®, as well as polymers that can be obtained from Degussa (Goldschmidt) under the trade name Tego®, among others, e.g. the anionic non-associative polymers known as Aculyn 22, Aculyn 28, and Aculyn 33 (cross-linked), Acusol 810, Acusol 823, and Acusol 830 (CAS 25852-37-3). In yet other examples, the polymeric rheology modifier can include cross-linked high-molecular-weight acrylic acid copolymers, which can include the copolymers of $C_{10-30}$ alkyl acrylates cross-linked with an allyl ether of the saccharose or of the pentaerythrite with one or more monomers selected from the group consisting of acrylic acid, methacrylic acid, and its monovalent esters (INCI: Acrylates/C10-30 Alkyl Acrylate Crosspolymer), which can also be formed with $C_{1-4}$ alkanols. Non-limiting examples of commercially available cross-linked high-molecular-weight acrylic acid copolymers can be obtained from Noveon under the Carbopol® trade names, e.g. hydrophobized Carbopol ETD 2623 and Carbopol 1382 (INCI: Acrylates/C10-30 Alkyl Acrylate Crosspolymer), as well as Carbopol Aqua 30 (previously known as Carbopol EX 473). It is noted that these are non-limiting examples of polymeric rheology modifiers and that many other polymeric rheology modifiers suitable for use with liquid surfactant compositions are known in the art. Regardless of the specific polymeric rheology modifier, in some examples, the liquid surfactant composition described herein is free of or substantially free of a polymeric rheology modifier or a particular polymeric rheology modifier.

As such, in some examples, the viscosity of the composition can be primarily controlled by the weight ratio of the first AES to the second AES and/or the weight ratio of various other surfactants in the composition, such as anionic surfactants to nonionic surfactants, for example.

In some specific examples, the weight ratio of first AES surfactant to second AES surfactant can be from about 0.05:1 to about 1:1. In yet other examples, the weight ratio of first AES surfactant to second AES surfactant can be from about 0.15:1 to about 0.35:1. In some examples, the weight ratio of first AES surfactant to second AES surfactant can provide a fresh viscosity of the composition from about 350 cps to about 550 cps without the addition of a polymeric rheology modifier. In other examples, the weight ratio of first AES surfactant to second AES surfactant can provide a fresh viscosity from about 375 cps to about 425 cps without the addition of a polymeric rheology modifier.

In further detail, the first AES surfactant can have a molecular formula of $R^1$—O—$(CH_2—CH_2—O)_m$—$SO_3M$. $R^1$ can represent a linear or branched, substituted or unsubstituted, alkyl, aryl, or alkylaryl group. Typically, $R^1$ can represent a $C_{10}$-$C_{20}$ alkyl group or a $C_{12}$-$C_{18}$ alkyl group. It is noted that where $R^1$ is designated as being an alkyl group within a specific distribution range, such as a $C_{12}$-$C_{18}$ alkyl group, it is meant that less than 5%, less than 2%, or less than 1% of the alkyl groups of $R^1$ fall outside of the designated range. In some examples, $R^1$ can be a $C_{10}$-$C_{15}$ alkyl group, or a $C_{10}$-$C_{13}$ alkyl group. In some other examples, $R^1$ can be a $C_{14}$-$C_{20}$ alkyl group. In some examples, $R^1$ can include about 1% or less of alkyl groups having a chain length of $C_{13}$ or less. In some examples, $R^1$ can include about 1% or less of alkyl groups having a chain length of $C_{14}$ or greater, or $C_{16}$ or greater. In some specific examples, $R^1$ can include at least 85%, at least 90%, or at least 95% $C_{12}$-$C_{13}$ alkyl groups. In some other specific examples, $R^1$ can include at least 85%, at least 90%, or at least 95% $C_{13}$-$C_{14}$ alkyl groups. In some specific examples, $R^1$ can include at least 85%, at least 90%, or at least 95% $C_{14}$-$C_{15}$ alkyl groups. In some other specific examples, $R^1$ can include at least 85%, at least 90%, or at least 95% $C_{15}$-$C_{16}$ alkyl groups. In some examples, $R^1$ can include at least 85%, at least 90%, or at least 95% of a decyl, undecyl, dodecyl, tridecyl, tetradecyl, pentadecyl, hexadecyl, heptadecyl, octadecyl, nonadecyl, or eicosyl group, or combinations thereof. In some specific examples, $R^1$ can include at least 85%, at least 90%, or at least 95% dodecyl.

The variable m can be a number from about 6 to about 8. This number can represent the average number of moles of $CH_2$—$CH_2$—O relative to the number of moles of $R^1$ or can represent the predominant number of moles of $CH_2$—$CH_2$—O relative to the number of moles of R. In some examples, m can be from about 6 to about 7. In some examples, m can be from about 7 to about 8. In some specific examples, m can be about 6. In other specific examples, m can be about 7. In yet other specific examples, m can be about 8.

The variable M can represent a monovalent cation. The first AES surfactant can be paired with a number of suitable monovalent cations. Non-limiting examples can include $Na^+$, $K^+$, HO—$CH_2CH_2NH_3^+$, $(HO—CH_2CH_2)_3NH^+$, the like, or combinations thereof.

In some examples, the first AES surfactant can be derived from an oleochemical source. In some examples, the first AES surfactant can be derived from a petrochemical source and/or can be produced via the Ziegler process, oxo-alcohol process, modified oxo-alcohol process, or other suitable process. In some specific examples, the first AES surfactant can be a modified oxo-alcohol-based surfactant. In other words, the first AES surfactant can be prepared via the modified oxo-alcohol process. In some examples, the non-ionic alcohol ether (AE) feedstock for the first AES surfactant can have an HLB range of from about 10.0 to about 14, or from about 11.0 to about 12.5. Further, in some examples, the first AES surfactant can include a distribution where the alkyl groups have odd numbered carbon chains. In such examples, the first AES surfactant can have a distribution of at least 10%, at least 20%, at least 30%, or at least 40% $C_{11}$, $C_{13}$, $C_{15}$, $C_{17}$, or $C_{19}$ alkyl groups, or a combination thereof. Further, in some examples, the first AES surfactant can have a distribution of branched alkyl groups. In such examples, the first AES surfactant can include a distribution of at least 10% or at least 15% branched alkyl groups. In some examples, the first AES surfactant can include a distribution ranging from about 10% to about 25% branched alkyl groups.

The second AES surfactant can also be prepared from any suitable feedstock via any suitable process. In some examples, the second AES surfactant can be derived from an oleochemical source. In some examples, the second AES surfactant can be derived from a petrochemical source and/or can be produced via the Ziegler process, oxo-alcohol process, modified oxo-alcohol process, or other suitable process.

The second AES surfactant can have a molecular formula of $R^2$—O—$(CH_2—CH_2—O)_n$—$SO_3M'$. $R^2$ can represent a linear or branched, substituted or unsubstituted, alkyl, aryl, or alkylaryl group. Typically, $R^2$ can represent a $C_{10}$-$C_{20}$ alkyl group or a $C_{12}$-$C_{18}$ alkyl group. It is noted that where $R^2$ is designated as being an alkyl group within a specific distribution range, such as a $C_{12}$-$C_{18}$ alkyl group, it is meant that less than 5%, less than 2%, or less than 1% of the alkyl groups of $R^2$ fall outside of the designated range. In some examples, $R^2$ can be a $C_{10}$-$C_{15}$ alkyl group, or a $C_{10}$-$C_{13}$ alkyl group. In some other examples, $R^2$ can be a $C_{14}$-$C_{20}$ alkyl group. In some examples, $R^2$ can include about 1% or less of alkyl groups having a chain length of $C_{13}$ or less. In some examples, $R^2$ can include about 1% or less of alkyl groups having a chain length of $C_{14}$ or greater, or $C_{16}$ or greater. In some specific examples, $R^2$ can include at least 85%, at least 90%, or at least 95% $C_{12}$-$C_{13}$ alkyl groups. In some other specific examples, $R^2$ can include at least 85%, at least 90%, or at least 95% $C_{13}$-$C_{14}$ alkyl groups. In some specific examples, $R^2$ can include at least 85%, at least 90%, or at least 95% $C_{14}$-$C_{15}$ alkyl groups. In some other specific examples, $R^2$ can include at least 85%, at least 90%, or at least 95% $C_{15}$-$C_{16}$ alkyl groups. In some examples, $R^2$ can include at least 85%, at least 90%, or at least 95% of a decyl, undecyl, dodecyl, tridecyl, tetradecyl, pentadecyl, hexadecyl, heptadecyl, octadecyl, nonadecyl, or eicosyl group, or combinations thereof. In some specific examples, $R^2$ can include at least 85%, at least 90%, or at least 95% dodecyl.

With respect to the variable n, this variable can represent the average number of moles of $CH_2$—$CH_2$—O relative to the number of moles of $R^2$ or the predominant number of moles of $CH_2$—$CH_2$—O relative to the number of moles of $R^2$. In some specific examples, n can be a number from about 2 to about 3. In some examples, n can be about 2. In other examples, n can be about 3.

The second AES surfactant can be paired with a number of suitable monovalent cations, represented by the variable M'. Non-limiting examples can include $Na^+$, $K^+$, HO—$CH_2CH_2NH_3^+$, $(HO—CH_2CH_2)_3NH^+$, the like, or combinations thereof.

In some examples, the second AES surfactant can be a modified oxo-alcohol-based surfactant. In other words, the second AES surfactant can be prepared via the modified oxo-alcohol process. Further, in some examples, the second AES surfactant can include a distribution of compounds with alkyl groups having odd numbered carbon chains. In such examples, the second AES surfactant can have a distribution of at least 10%, at least 20%, at least 30%, or at least 40% $C_{11}$, $C_{13}$, $C_{15}$, $C_{17}$, or $C_{19}$ alkyl groups, or a combination thereof. Further, in some examples, the second AES surfactant can have a distribution of branched alkyl groups. In such examples, the second AES surfactant can include a distribution of at least 10% or 15% branched alkyl groups. In some examples, the second AES surfactant can include a distribution of about 10% to about 25% branched alkyl groups.

The liquid surfactant composition can also include a variety of additional components. Non-limiting examples can include water, organic solvents, optical brighteners, opacifiers, colorants, additional surfactants, fatty acids or salts thereof, anti-foaming agents, enzymes, polymers, bleaching agents, chelating agents, builders, electrolytes, pH adjusters, fragrances, fragrance carriers, anti-redepositing agents, shrinkage inhibitors, anti-wrinkle agents, color transmission inhibitors, anti-microbials, germicides, fungicides, anti-oxidants, preservatives, corrosion inhibitors, antistatic agents, ironing aids, swelling agents, softening components, the like, or combinations thereof.

For example, water can be included in the liquid surfactant composition in a variety of amounts. In some examples, the liquid surfactant composition can include from 20 wt % to 80 wt % water. In yet other examples, the liquid surfactant composition can include from 30 wt % to 70 wt % water. In other examples, the liquid surfactant composition can include from 40 wt % to 60 wt % water.

In some examples, the liquid surfactant composition can include additional soap(s) as an anionic surfactant. Soaps are the water-soluble sodium or potassium salts of saturated and unsaturated fatty acids having 10 to 20 carbon atoms, such as the resin acids of rosin (yellow resin soaps) and naphthenic acids, which are primarily used for washing and cleaning purposes as solid or semi-solid mixtures. In some examples, the liquid surfactant composition can include a salt (e.g. a sodium or potassium salt) of saturated or unsaturated fatty acids having 10 to 20 carbon atoms. In yet other examples, the liquid surfactant composition can include a salt (e.g. sodium or potassium salt) of saturated or unsaturated fatty acids having 12 to 18 carbon atoms. In some examples, the salt of a saturated or unsaturated fatty acid can be present in the liquid surfactant composition in an amount from about 0.1 wt % to about 15 wt %, or from 0.2 wt % to 12 wt %, or from 0.3 wt % to 10 wt %.

In some other examples, the liquid surfactant composition can include an organic solvent. The organic solvent can be a solvent that has a covalent bond between a carbon atom and a hydrogen atom. Further, the organic solvent can be a liquid that has a solubility of at least 1 g in 100 g distilled water at 20° C. In some examples, the organic solvent can be free of an amino group. Non-limiting examples of suitable organic solvents can include ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, or propylene glycol propylene ether, dipropylene glycol monomethyl ether, dipropylene glycol monoethyl ether, methoxy triglycol, ethoxy triglycol, butoxy triglycol, 1-butoxyethoxy-2-propanol, 3-methyl-3-methoxybutanol, propylene glycol-t-butylether, di-n-octylether, the like, or combinations thereof. In some specific examples, the organic solvent can include ethanol and/or glycerol and/or 1,2-propanediol. Where the organic solvent is included in the liquid surfactant composition, it can be included in an amount from about 1 wt % to 10 wt % or from about 1.5 wt % to about 8 wt %.

In some specific examples, the liquid surfactant can include a polyalkoxylated polyamine. The polyalkoxylated polyamine can be a polymer having an N-atom-containing backbone, which can carry the polyalkoxy groups at the N atoms. The polyamine can have primary amino groups at the ends (terminus and/or side chains). The polyamine can also have secondary and/or tertiary amino groups internally. In some specific examples, the polyamine can have solely secondary amino groups internally, such that a branched-chain, but also a linear polyamine results. In some examples, the ratio between the primary and secondary amino groups in the polyamine can range from 1:0.5 to 1:1.5, or from 1:0.7 to 1:1, but any suitable range can be used. In some further examples, the ratio between the primary and tertiary amino groups in the polyamine can range from 1:0.2 to 1:1, or from 1:0.5 to 1:0.8, but any suitable range can be used. In some examples, the polyamine can have an average molecular weight in a range of from 500 g/mol to 50,000 g/mol, or from 550 g/mol to 5000 g/mol. It is noted that where a polyalkoxylated polyamine as described herein is included in the liquid surfactant composition, it is not considered a polymeric rheology modifier.

The N atoms in the polyamine can be separated from one another by alkylene groups, such as alkylene groups having from 2 to 12 carbon (C) atoms, or from 2 to 6 C atoms, wherein not all alkylene groups necessarily have the same number of C atoms. In some specific examples, the alkylene groups can include ethylene groups, 1,2-propylene groups, 1,3-propylene groups, and mixtures thereof. Polyamines that include ethylene groups as the said alkylene group can also be characterized as polyethylenimine, or PEI. In some examples, the polyalkoxylated polyamine can be a PEI.

In some specific examples, the primary amino groups in the polyamine can carry 1 or 2 polyalkoxy groups and/or the secondary amino groups can carry 1 polyalkoxy group, wherein not every amino group has to be alkoxy-group-substituted. The average number of alkoxy groups per primary and secondary amino function in the polyalkoxylated polyamine can generally range from 1 to 100, or in some examples from 5 to 50. Further, in some examples, the alkoxy groups in the polyalkoxylated polyamine can be polypropoxy groups that are directly bound to N atoms and/or polyethoxy groups that are bound to optionally available propoxy radicals and to N atoms, which do not carry any propoxy groups.

Polyethoxylated polyamines can be obtained in a variety of ways, such as by converting polyamines with ethylene oxide (EO). In other examples, polyalkoxylated polyamines can be obtained by converting polyamines with propylene oxide (PO). Conversion with PO can also be followed by subsequent conversion with ethylene oxide. Thus, the polyalkoxylated polyamines can include various proportions of ethyoxy and/or propoxy groups. For example, in some cases, the portion of propylene oxide in the total quantity of the alkylene oxide can be from 2 molar % to 18 molar %, or from 8 molar % to 15 molar %. In yet other examples, the average number of propoxy groups per primary and secondary amino group in the polyalkoxylated polyamine can range from 1 to 40, or from 5 to 20. In yet additional examples, the average number of ethoxy groups per primary and secondary amino group in the polyalkoxylated polyamine can be from 10 to 60, or from 15 to 30. In some examples, where desired, a terminal OH group of a polyalkoxy substituent in the polyalkoxylated polyamine can be partially or completely etherized with a $C_1$-$C_{10}$, or $C_1$-$C_3$, alkyl group.

In some specific examples, the polyalkoxylated polyamines can be selected from the group consisting of a polyamine converted with 45 EO per primary and secondary amino group, a PEI converted with 43 EO per primary and secondary amino group, a PEI converted with 5 EO+5 PO per primary and secondary amino group, a PEI converted with 15 PO+30 EO per primary and secondary amino group, a PEI converted with 5 PO+39.5 EO per primary and secondary amino group, a PEIs converted with 5 PO+15 EO per primary and secondary amino group, a PEI converted with 10 PO+35 EO per primary and secondary amino group, a PEI converted with 15 PO+30 EO per primary and secondary amino function, a PEI converted with 15 PO+5 EO per primary and secondary amino group, and combinations thereof. In one specific example, the alkoxylated polyamine can be a PEI with a content of from about 10 to about 20 nitrogen atoms converted with about 20 EO units per primary or secondary amino function of the polyamine.

Where the liquid surfactant composition includes a polyalkoxylated polyamine, the polyalkoxylated polyamine can be present in the composition in an amount from about 0.1 wt % to about 10 wt %. In some additional examples, the polyalkoxylated polyamine can be present in the composition in an amount from about 0.5 wt % to about 5.0 wt %.

In some other examples, the liquid surfactant composition can include one or more bleaching agents that break down or absorb dyes through oxidation, reduction, or adsorption and thereby remove color from materials. Non-limiting examples can include hypohalogenite-containing bleaching agents, hydrogen peroxide, perborate, percarbonate, peroxoacetic acid, diperoxo azelaic acid, diperoxo dodecanoic diacid, hypochlorite, oxidative enzyme systems, the like, or combinations thereof.

In yet other examples, the liquid surfactant composition can include a variety of builders. Non-limiting examples can include silicates, aluminum silicates (such as zeolites), carbonates, diethylenetriamine pentaacetate, salts of polycarboxylic acids, the like, or combinations thereof. Polycarboxylic acids can include citric acid, adipic acid, succinic acid, glutaric acid, malic acid, tartaric acid, maleic acid, fumaric acid, sugar acids, amino carboxylic acids, the like, or combinations thereof.

In additional examples, the liquid surfactant composition can include a variety of enzymes. Any suitable enzyme for use in a liquid detergent composition can be used. Non-limiting examples can include any suitable amylase, mannanase, pectinase, protease, cellulase, lipase, the like, or combinations thereof.

As used herein, a "variant" is at the level of proteins of the term corresponding with "mutant" at the nucleic acid level. The predecessor or starting molecules can be wild-type enzymes, i.e. those that can be obtained from natural sources. They can also be enzymes that represent variants that have already been modified, i.e. with respect to the wild-type molecules. These can include, for example, point mutants, those with changes in the amino acid sequence over multiple positions or longer contiguous areas, or even hybrid molecules that are composed from complementary sections of various wild-type enzymes.

Addition of a suitable enzyme can improve the overall cleaning performance of the liquid surfactant composition. Cleaning performance is understood to mean the capacity to brighten one or more stains, particularly on laundry or dishes. The cleaning performance of an enzyme thus contributes to the overall cleaning performance of the liquid surfactant composition or the wash or cleaning bath formed by the liquid surfactant composition.

In general, the enzyme can be added to the liquid surfactant compositions in any form that is established according to the prior art. For example, an enzyme included in the liquid surfactant composition can be absorbed onto support substances and/or embedded in shell substances to protect them against premature inactivation. Non-limiting examples can include solid preparations obtained through granulation, extrusion, or lyophilization, advantageously as concentrated as possible, with small amounts of water and/or offset with stabilizers. In an alternative form of administration, the enzymes can also be encapsulated. This can be accomplished, for example, through spray-drying or extrusion of an enzyme solution together with natural polymer or in the form of a capsule. For example, the enzyme can be enclosed as if in a solid gel or those of the core-shell type, in which an enzyme-containing core is coated with a protective layer that is impermeable to water, air, and/or chemicals. Additional ingredients can be applied, for example stabilizers, emulsifiers, pigments, bleaching agents, or dyes, optionally in layers. These types of capsules can be created according to known methods, for example through agitating or rolled granulation or in fluid-bed processes. Advantageously, these types of granular masses can be low-dust grains due to the application of polymeric film formers and can have a long shelf life due to the coating.

With this in mind, in some specific examples, the liquid surfactant composition can include a protease enzyme. A protease is an enzyme that cleaves off peptide bonds by means of hydrolysis, or an enzyme that has protease activity. "Protease activity" is considered to be present when the enzyme has proteolytic activity. The protease activity can be determined according to the method described in *Surfactants*, Volume 7 (1970), pgs. 125-132. It is stated accordingly in PE (protease units). The protease activity of an enzyme can be determined according to common standard methods such as, in particular, using BSA as a substrate (bovine albumin) and/or using the AAPF method. For example, each of the enzymes from class E.C. 3.4 can be considered a protease enzyme (including each of the 13 sub-classes). The EC number corresponds to the 1992 Enzyme Nomenclature of the NC-IUBMB, Academic Press, San Diego, Calif., including supplements 1 to 5, published in Eur. J. Biochem. 1994, 223, 1-5; Eur. J. Biochem. 1995, 232, 1-6; Eur. J. Biochem. 1996, 237, 1-5; Eur. J. Biochem. 1997, 250, 1-6; and Eur. J. Biochem. 1999, 264, 610-650. In some examples, the liquid surfactant composition can include from about 0.1 wt % to about 5 wt %, or from about 0.5 wt % to about 3 wt % of protease enzyme.

In some additional examples, the liquid surfactant composition can include a cullulase. Synonymous terms can be used for cellulases, particularly endoglucanase, endo-1,4-beta-glucanase, carboxymethylcellulase, endo-1,4-beta-D-glucanase, beta-1,4-glucanase, beta-1,4-endoglucanhydrolase, celludextrinase, or avicelase. A cellulose enzyme can be determined by its ability to hydrolyze 1,4-ß-D-glucosidic bonds in cellulose. Commercially available examples can include the fungal, endoglucanase(EG)-rich cellulase preparation or the further developments thereof sold by Novozymes under the trade name Celluzyme®. Additionally, products called Endolase® and Carezyme®, which are also sold by Novozymes, are based on 50 kD-EG or 43 kD-EG from *Humicola insolens* DSM 1800. Other usable commercial products from this company are Cellusoft®, Renozyme®, and Celluclean®. Also usable are cellulases, for example, sold by AB Enzymes, in Finland, under the trade names Ecostone® and Biotouch®, and which are at least partially based on the 20 kD-EG from *Melanocarpus*.

Other cellulases from AB Enzymes are Econase® and Ecopulp®. Additional suitable cellulases are from *Bacillus* sp. CBS 670.93 and CBS 669.93, wherein the one from *Bacillus* sp. CBS 670.93 sold by Danisco/Genencor is available under the trade name Puradax®. Additional usable commercial products from Danisco/Genencor include "Genencor detergent cellulase L" and IndiAge®Neutra. However, any suitable cellulase enzyme can be used. In some examples, the cellulase can be present in the liquid surfactant composition in an amount from about 0.01 wt % to 1 wt %, or from 0.05 wt % to 0.5 wt %.

In some additional examples, the liquid surfactant composition can also include a lipase enzyme. Non-limiting examples of lipase enzymes can include an enzyme of the group that is formed from triacylglycerol lipase (E.C. 3.1.1.3), lipoprotein lipase (E.C. 3.1.1.34), monoglyceride lipase (E.C. 3.1.1.23), and combinations thereof. In some examples, the lipase can be active in an alkaline medium. Furthermore, in some examples, the lipase can be naturally available from a microorganism such as *Thermomyces lanuginosus* or *Rhizopus oryzae* or *Mucor javanicus* species, or can be derived from the aforementioned naturally available lipases via mutagenesis. In one specific example, the lipase can be naturally available from a microorganism of the *Thermomyces lanuginosus* species or derived from the aforementioned lipases naturally available from *Thermomyces lanuginosus* via mutagenesis.

In this context, naturally available means that the lipase is an inherent enzyme of the microorganism. The lipase can consequently be expressed by a nucleic acid sequence, which is part of the chromosomal DNA of the microorganism in its wild-type form. It or the nucleic acid sequence coding for it is consequently available in the wild-type form of the microorganism and/or can be isolated from the wild-type form of the microorganism. Contrary to this, a lipase that is not naturally available in the microorganism and/or the nucleic acid sequence coding for it can be incorporated into the microorganism in a targeted manner with the assistance of genetic processes, such that the microorganism can be enriched by the lipase and/or the nucleic acid sequence coding for it. However, a lipase that is naturally available from a microorganism of the *Thermomyces lanuginosus* or *Rhizopus oryzae* or *Mucor javanicus* species can be produced by a different organism, but can be quite recombinant in nature.

Lipase is commercially available from a variety of sources, such as Amano Pharmaceuticals under the designations Lipase M-AP10®, Lipase LE®, and Lipase F® (as well as Lipase JV®). Lipase F® is naturally available, for example, in *Rhizopus oryzae*. Lipase M-AP10® is naturally available, for example, in *Mucor javanicus*. Lipex® from Novozymes (Denmark) is another non-limiting example of a commercially available lipase enzyme.

The lipase enzyme can be included in the composition in various amounts. In some examples, the lipase can be present in the liquid surfactant composition in an amount from about 0.01 wt % to about 1 wt %, or from about 0.05 wt % to about 0.2 wt %.

In some examples, the liquid surfactant composition can also include a mannanase enzyme. A mannanase can catalyze the hydrolysis of 1,4-beta-D-mannosidic bonds in mannans, galactomannans, glucomannans, and galactoglucomannans, within the scope of their mannanase activity. Said mannanase enzymes can be classified as E.C. 3.2.1.78 according to the enzyme nomenclature. The mannanase activity of a polypeptide or enzyme can be determined according to the test methods known in the literature. In doing so, a test solution can be placed in 4 mm-diameter holes of an agar plate containing 0.2% by weight AZGL galactomannan (carob), i.e. a substrate for the endo-1,4-beta-D-mannanase assay, obtainable from Megazyme.

In some examples, the mannanase enzyme can be obtained or derived from the gram-positive alkalophilic phyla of *Bacillus*, such as a member of the group consisting of *Bacillus subtilis, Bacillus lentus, Bacillus clausii, Bacillus agaradhaerens, Bacillus brevis, Bacillus stearothermophilus, Bacillus alkalophilus, Bacillus amyloliquefaciens, Bacillus coagulans, Bacillus circulans, Bacillus lautus, Bacillus thuringiensis, Bacillus cheniformis*, and *Bacillus* sp. In some specific examples, the mannanse enzyme can be obtained from *Bacillus* sp. 1633, *Bacillus* sp. AAI12, *Bacillus clausii, Bacillus agaradhaerens*, or *Bacillus licheniformis*. Non-limiting examples of commercially available mannanase enzylnes can be obtained from Novozymes under the name Mannaway®.

Where the liquid surfactant composition includes a mannanase, it can generally be present in an amount from 0.01 wt % to 1.0 wt %. In some additional examples, the mannanse can be present in an amount from 0.02 wt % to 0.5 wt %.

In yet additional examples, the liquid surfactant composition can include an amylase enzyme. More specifically, α-amylases (E.C. 3.2.1.1) can hydrolyze internal α-1,4-glycosidisic bonds of starch and starch-like polymers as an enzyme. This α-amylase activity can be measured in KNU (Kilo Novo Units), wherein 1 KNU stands for the enzyme quantity that hydrolyzes 5.25 g of starch (obtainable from Merck, Darmstadt, Germany) per hour at 37° C., pH 5.6 and in the presence of 0.0043 M calcium ions. An alternative activity determination method is the so-called DNS method, which is described, for example, in application WO 02/10356 A2. Specifically, the oligosaccharides, disaccharides, and glucose units released during the hydrolysis of starch are verified through oxidation of the reducing ends with dinitrosalicysic acid (DNS). The activity is obtained in μmol reducing sugar (based on maltose) per min and ml, which can result in activity values in the thousands. The same enzyme can be determined via various methods, wherein the respective conversion factors may vary depending on the enzyme and therefore must be specified by means of a standard. Approximately, it can be stated that 1 KNU is about 50,000 for calculation purposes. A further activity determination method is the measurement using the quick Start® test kit from Abbott, Abott Park, Ill., USA.

In some examples, the α-amylases can be active in an alkaline medium. In some further examples, the α-amylases can be primarily produced and secreted by microorganisms, i.e. fungi or bacteria, such as those of the genera *Aspergillus* and *Bacillus*. Starting from these natural enzymes, there is a practically incalculable abundance of variants available that have been derived via mutagenesis and have specific advantages depending on the application area.

Non-limiting examples of these are the α-amylases from *Bacillus licheniformis*, from *B. amyloliquefaciens*, and from *B. stearothermophilus*, as well as those further developments improved for use in detergents or cleaning agents. The enzyme from *B. licheniformis* can be obtained from Novozymes under the name Termamyl® and from Genencor under the name Purastar®ST. Further development products of this α-amylase are sold by Novozymes under the trade names Duramyl and Termamylultra, by Genencor under the name PurastarOxAm, and by Daiwa Seiko Inc., in Tokyo, Japan, as Keistase®. An α-amylase from *B. amyloliquefaciens* is sold by Novozymes under the name BAN and derived variants of the α-amylase from *B. stearothermophilus* are also sold by Novozymes under the names BSG and Novamyl. Examples of further developments of α-amylases from other organisms can include α-amylase from *Aspergillus niger* and *A. oryzae* obtainable from Novozymes under the trade name Fungamyl®. Another commercial product is, for example, Amylase-LT®.

Where α-amylase is included in the liquid surfactant composition, it can be included in various amounts. For example, α-amylase can be included in the liquid surfactant composition in an amount from 0.01 wt % to 3.0 wt %, or from 0.02 wt % to 1.0 wt %.

In additional examples, the liquid surfactant composition can include a pectinase enzyme. Pectinases can be used to degrade pectins, which are a family of complex polysaccharides that contain 1,4-linked α-D-galactosyluronic acid residues. Pectinases can catalyze the cleavage of (1,4)-α-D-galacturonan to give oligosaccharides with 4-deoxy-alpha-D-galact-4-enuronosyl groups at their non-reducing ends. Thus, the pectinases can cleave pectin into smaller fragments that are easier to remove during washing and can provide additional stain removal properties to the liquid surfactant composition. For example, pectinase enzymes can help eliminate stains from fresh fruits, tomato sauces, jams, low-fat dairy products, the like, or combinations thereof.

Where a pectinase is included in the liquid surfactant composition, it can be included in various amounts. For example, pectinase can be included in the liquid surfactant composition in an amount from 0.01 wt % to 1.0 wt %. In some additional examples, the pectinase can be present in an amount from 0.02 wt % to 0.5 wt %.

While the liquid surfactant composition can include a variety of components, in some examples, the liquid surfactant composition can be clear. By clear, it is meant that the liquid surfactant composition has an NTU (Nephelometric Turbidity Unit) value of ≤5.0. In yet other examples, the liquid surfactant composition can have an NTU value of ≤2.5 or ≤1.5.

The NTU value can be determined using a variety of methods. In one specific example, the method used for determining the NTU value is DIN EN ISO 7027 "Determination of turbidity"—procedure 3. In this example, the sample is irradiated with light at a wavelength of about 860 nm and the intensity of scattered light that is diffracted at an angle of 90° relative to the incident light is measured and recorded. Typically, a greater number of particles present in the liquid detergent can cause greater scattering of the light and a higher recorded value of light diffracted at an angle of 90° relative to the incident light. The calibration can be conducted with a reference suspension with well-defined turbidity values.

The liquid surfactant composition can be included in a liquid surfactant system. The liquid surfactant system can include a container in which the liquid surfactant composition can be enclosed or contained. In some examples, the container can be clear or transparent. However, it is noted that where the container is clear, some parts of the container, such as a lid, a dispensing nozzle (when included), the like, or a combination thereof may not be clear or transparent. In some examples, the liquid surfactant system can include a measuring cup. In some specific examples, the measuring cup can also be a lid for the container. The container can be made of a variety of suitable materials. Non-limiting examples can include polyethylene, polypropylene, polyvinyl chloride, polycarbonate, polyethylene terephthalate, the like, or a combination thereof. Further, the container can include appropriate labeling that can include instructions for use, a listing of ingredients, appropriate source-identifying information, the like, or combinations thereof.

The liquid surfactant composition can be manufactured in a variety of ways. In one example, a method of manufacturing can include providing an aqueous vehicle, combining a $C_9$-$C_{20}$ alkylbenzene sulfonate with the aqueous vehicle, combining a nonionic surfactant with the aqueous vehicle, and combining an anionic surfactant with the aqueous vehicle. The $C_9$-$C_{20}$ alkylbenzene sulfonate, nonionic surfactant, and anionic surfactant can be the same as those described above.

As previously described, the anionic surfactant can include a first AES surfactant and a second AES surfactant that are combined at weight ratios to provide the final composition with a suitable viscosity. These weight ratios are described above. Further, in some examples, the alkylbenzene sulfonate and the nonionic surfactant can be combined at a weight ratio of from 2:1 to 1:5, or from 1.5:1 to 1:3, or from 1:1 to 1:2. In some additional examples, the nonionic surfactant and the anionic surfactant can be combined at a weight ratio of from 1:1.5 to 1:10, or from 1:2.5 to 1:5.5. As previously described, a variety of other components can also be included in the liquid surfactant composition in appropriate amounts and weight ratios.

EXAMPLES

Example 1—Effect of Different Ratios of Alcohol Ether Sulfates on Viscosity

Seven different formulations of liquid surfactant compositions were prepared. Each of the seven formulations had an identical composition, except that the weight ratio of first AES surfactant to second AES surfactant was adjusted for each formulation to determine the effect of the different ratios on the viscosity of the formulation. Further, none of the compositions included a polymeric rheology modifier to control the viscosity. Rather, the viscosities of the various compositions were primarily controlled using the ratios of the various surfactants, such as first AES to second AES. The various formulations used in this example are listed generally in Table 1 below.

TABLE 1

Liquid Surfactant Composition Formulations

| Ingredient | Sample 1 | Sample 2 | Sample 3 | Sample 4 | Sample 5 | Sample 6 | Sample 7 |
|---|---|---|---|---|---|---|---|
| Water | q.s. | q.s. | q.s. | q.s. | q.s. | q.s. | q.s. |
| Propylene Glycol | 2-3 | 2-3 | 2-3 | 2-3 | 2-3 | 2-3 | 2-3 |
| Sodium Hydroxide | 2-3 | 2-3 | 2-3 | 2-3 | 2-3 | 2-3 | 2-3 |
| Boric Acid | 1-2 | 1-2 | 1-2 | 1-2 | 1-2 | 1-2 | 1-2 |

TABLE 1-continued

| Liquid Surfactant Composition Formulations | | | | | | | |
|---|---|---|---|---|---|---|---|
| Ingredient | Sample 1 | Sample 2 | Sample 3 | Sample 4 | Sample 5 | Sample 6 | Sample 7 |
| Citric Acid | 2-3 | 2-3 | 2-3 | 2-3 | 2-3 | 2-3 | 2-3 |
| Alcohol Ethyoxylate | 2-10 | 2-10 | 2-10 | 2-10 | 2-10 | 2-10 | 2-10 |
| Sodium Dodecyl Benzenesulfonate | 1-10 | 1-10 | 1-10 | 1-10 | 1-10 | 1-10 | 1-10 |
| Fatty Acid | 2-3 | 2-3 | 2-3 | 2-3 | 2-3 | 2-3 | 2-3 |
| Alcohol Ether Sulfate-7 mole | 3 | 0 | 17.7 | 14.7 | 8.85 | 1 | 5 |
| Alcohol Ether Sulfate-2 mole | 14.7 | 17.7 | 0 | 3 | 8.85 | 16.7 | 12.7 |
| Tetrasodium EDTA | 1-2 | 1-2 | 1-2 | 1-2 | 1-2 | 1-2 | 1-2 |
| Silicone Anti-Foam | 0.01-1 | 0.01-1 | 0.01-1 | 0.01-1 | 0.01-1 | 0.01-1 | 0.01-1 |
| Ethanol | 1-2 | 1-2 | 1-2 | 1-2 | 1-2 | 1-2 | 1-2 |
| Sodium Formate | 0.01-1 | 0.01-1 | 0.01-1 | 0.01-1 | 0.01-1 | 0.01-1 | 0.01-1 |
| Polyethyleneimine | 2-3 | 2-3 | 2-3 | 2-3 | 2-3 | 2-3 | 2-3 |
| Optical Brightener | 0.01-1 | 0.01-1 | 0.01-1 | 0.01-1 | 0.01-1 | 0.01-1 | 0.01-1 |
| Enzymes | 2-3 | 2-3 | 2-3 | 2-3 | 2-3 | 2-3 | 2-3 |
| Fragrance | 1-2 | 1-2 | 1-2 | 1-2 | 1-2 | 1-2 | 1-2 |
| Liquitint Blue HP | 0.001 | 0.001 | 0.001 | 0.001 | 0.001 | 0.001 | 0.001 |

Note:
All values are weight percentages of active matter (except for enzymes).
Enzymes are listed in wt % as is.

The first AES surfactant used in this example was based on a Surfonic® L24-7 feedstock (average ethoxylation—7 mol) obtained from Huntsman. The Second AES surfactant used in this example was based on a Surfonic® L24-2 feedstock (average ethoxylation—2 mol) obtained from Huntsman. Both of these feedstocks had a distribution of greater than 65% $C_{12}$ alkyl chains. Further, the first AES feedstock had an HLB value of about 12, whereas the second AES feedstock had an HLB value of about 6.

Table 2 summarizes the amount of the first AES surfactant and the second AES surfactant as a percentage of total AES surfactant content in the composition. Additionally, Table 2 provides weight ratios of first AES surfactant to second AES surfactant for each of the compositions. Corresponding fresh viscosities, and 1 week stability viscosities at 25° Celsius and 600 Celsius are also provided in units of centipoise (cps).

TABLE 2

| Ratios of First AES Surfactant to Second ABS Surfactant | | | | | | | |
|---|---|---|---|---|---|---|---|
| | Sample 1 | Sample 2 | Sample 3 | Sample 4 | Sample 5 | Sample 6 | Sample 7 |
| % $1^{st}$ AES (7 mol AES) | 16.95 | 0 | 100 | 83.05 | 50 | 5.65 | 28.25 |
| % $2^{nd}$ AES (2 mol AES) | 83.05 | 100 | 0 | 16.95 | 50 | 94.35 | 71.75 |
| Ratio ($1^{st}$:$2^{nd}$) | 0.204 | n/a | n/a | 4.9 | 1 | 0.06 | 0.394 |
| Viscosity (fresh) | 396 | 366 | 819 | 696 | 473 | 359 | 420 |
| Viscosity (1 wk-25 C.) | 353 | 318 | 709 | 590 | 440 | 339 | 392 |
| Viscosity (1 wk-60 C.) | 342 | 312 | 686 | 568 | 452 | 325 | 388 |

As can be seen in Table 2, relatively high levels of the first AES surfactant compared to the second AES surfactant can typically result in a relatively high viscosity. Conversely, relatively high levels of the second AES surfactant compared to the first AES surfactant can typically result in a relatively low viscosity.

Example 2—Effect of Different Ratios of Alcohol Ether Sulfates on Washing Performance The same compositions described in Example 1 were evaluated for washing performance.

Stain removal was tested in accordance with ASTM D4265-14—the Standard Guide for Evaluating Stain Removal Performance in Home Laundering. 5 stains listed in the standard (beef tallow/pork lard, soot/olive oil, make-up, butterfat) with a high sensitivity to the surfactants were tested with the different detergent formulations in top-loader washing machines using a dosage of 1.5 oz per wash (6 repetitions each). To evaluate the effectiveness of stain removal a Spectrophotometer Spectraflash 600 (Software guided remission spectrophotometer aimed of measuring color parameters of textiles) was used. Only statistically significant differences in stain removal between the different detergent formulations were counted as "wins" or "losses".

Whiteness Maintenance was based on a test method used to evaluate the effectiveness of whiteness retention and prevention of soil re-deposition. Similarly sized pieces of cotton and poly-cotton fabric swatches (4"×4") were homogenously soiled with sebum soil (0.04 oz per 20 pieces) and clay soil (0.08 oz per 20 pieces) and were washed in a conventional Tergotometer™ detergent tester (Copley scientific) over multiple cycles. The detergent to be tested was dosed with 1.5 oz/5 gallon. A BYK-Gardner Color-Guide Spectrophotometer was then used to measure the whiteness of the swatches before and after the test. The fabric samples were evaluated using a scale of percentage of whiteness retention calculated as the (final whiteness value/initial whiteness value)*100. The whiteness scale 0% indicates no whiteness retention and 100% indicates complete whiteness retention.

The results of the washing performance study are illustrated in Table 3 below. Sample 1 was used as a baseline value for the stains evaluation.

TABLE 3

| | Washing Performance | | | | | | |
|---|---|---|---|---|---|---|---|
| | Sample 1 | Sample 2 | Sample 3 | Sample 4 | Sample 5 | Sample 6 | Sample 7 |
| Stains removal (wins/losses) | 0 | −1 | 0 | 0 | 0 | 0 | 0 |
| Whiteness Maintenance (Cotton) | 98.59 | 98.58 | 98.22 | 98.06 | 98.64 | 98.55 | 98.50 |
| Whiteness Maintenance (Poly-Cotton) | 99.30 | 99.08 | 99.16 | 98.43 | 98.76 | 98.93 | 98.80 |

As illustrated in Table 3, Sample 2 had the worst stain removal performance of all of the samples. Otherwise, the stain removal performance of the various formulations was comparable. With respect to whiteness maintenance, Sample 5 had the best performance with cotton fabrics and Sample 1 had the best performance with poly-cotton blends. However, Sample 1 also had the second best performance with cotton fabrics. Thus, Sample 1 appeared to have the overall best performance of the various formulations.

It should be understood that the above-described methods are only illustrative of some embodiments of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that variations including, may be made without departing from the principles and concepts set forth herein.

What is claimed is:

1. A liquid surfactant composition, comprising:

a $C_9$-$C_{20}$ alkylbenzene sulfonate;

a nonionic surfactant; and an anionic surfactant, said anionic surfactant comprising:

a first alcohol ether sulfate (AES) surfactant having a molecular formula of $R^1$—O—$(CH_2$—$CH_2$—$O)_m$—$SO_3M$, wherein $R^1$ represents a $C_{10}$-$C_{20}$ alkyl group, m represents a number from 6 to 8, and M represents a monovalent cation, and a second AES surfactant having a molecular formula of $R^2$—O—$(CH_2$—$CH_2$—$O)_n$—$SO_3M'$, wherein $R^2$ is a $C_{10}$-$C_{20}$ alkyl group, n is 2 or 3, and M' is a monovalent cation, wherein the first AES surfactant and the second AES surfactant are present at a weight ratio of from 0.05:1 to 1:1 to provide the liquid surfactant composition with a fresh viscosity of from about 350 centipoise (cps) to about 550 cps, wherein the nonionic surfactant and the anionic surfactant are present at a weight ratio of from 1:1.5 to 1:10, and wherein the liquid surfactant composition is free of a polymeric rheology modifier.

2. The liquid surfactant composition of claim 1, wherein the alkylbenzene sulfonate is present in an amount from about 1 wt % to about 10 wt % of the composition.

3. The liquid surfactant composition of claim 1, wherein the alkylbenzene sulfonate is a $C_{10}$-$C_{15}$ alkylbenzene sulfonate.

4. The liquid surfactant composition of claim 1, wherein the alkylbenzene sulfonate has a molecular formula of

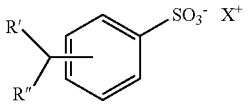

wherein R' and R" jointly have from 8 to 19 C atoms and $X^+$ represents a monovalent cation that is a member selected from the group consisting of: $Na^+$, $K^+$, HO—$CH_2CH_2NH_3^+$, $(HO—CH_2CH_2)_3NH^+$, and combinations thereof.

5. The liquid surfactant composition of claim 1, wherein the nonionic surfactant is present in an amount of from about 1 wt % to about 10 wt % of the composition.

6. The liquid surfactant composition of claim 1, wherein the nonionic surfactant has a molecular formula of $R^3$—O-$(AO)_q$—H, wherein $R^3$ represents a $C_{10}$-$C_{20}$ alkyl group, AO represents an ethylene oxide or propylene oxide group, and q represents a number from 1 to 20.

7. The liquid surfactant composition of claim 1, wherein the anionic surfactant is present in an amount of from about 15 wt % to about 25 wt %.

8. The liquid surfactant composition of claim 1, wherein the first AES surfactant and the second AES surfactant are present in a weight ratio of from about 0.15:1 to about 0.35:1.

9. The liquid surfactant composition of claim 1, wherein the first AES is a modified oxo-alcohol-based surfactant.

10. The liquid surfactant composition of claim 1, wherein m=7.

11. The liquid surfactant composition of claim 1, wherein M is a monovalent cation that is a member selected from the group consisting of: $Na^+$, $K^+$, $HO—CH_2CH_2NH_3^+$, $(HO—CH_2CH_2)_3NH^+$, and combinations thereof.

12. The liquid surfactant composition of claim 1, wherein the second AES surfactant is a modified oxo-alcohol-based surfactant.

13. The liquid surfactant composition of claim 1, wherein n is 2.

14. The liquid surfactant composition of claim 1, wherein M' is a monovalent cation that is a member selected from the group consisting of: $Na^+$, $K^+$, $HO—CH_2CH_2NH_3^+$, $(HO—CH_2CH_2)_3NH^+$, and combinations thereof.

15. The liquid surfactant composition of claim 1, wherein the liquid surfactant composition has a 1 week storage viscosity at 25° Celsius from about 340 cps to about 450 cps.

16. The liquid surfactant composition of claim 1, wherein the anionic surfactant and the nonionic surfactant are present in a weight ratio of from about 2.5:1 to about 5.5:1.

17. The liquid surfactant composition of claim 1, further comprising water, an organic solvent, a builder, an optical brightener, an opacifier, a colorant, a fatty acid, an anti-foaming agent, an enzyme, a fragrance, a pH adjuster, a polymer, or a combination thereof.

18. The liquid surfactant composition of claim 1, wherein the composition has a fresh viscosity of from about 350 cps to about 425 cps.

19. A method of manufacturing a liquid surfactant composition, comprising:

providing an aqueous vehicle;

combining a $C_9$-$C_{20}$ alkylbenzene sulfonate with the aqueous vehicle;

combining a nonionic surfactant with the aqueous vehicle;

combining an anionic surfactant with the aqueous vehicle, said anionic surfactant comprising:

a first alcohol ether sulfate (AES) surfactant having a molecular formula of $R^1—O—(CH_2—CH_2—O)_m—SO_3M$, wherein $R^1$ represents a $C_{10}$-$C_{20}$ alkyl group, m represents a number from 6 to 8, and M represents a monovalent cation, and a second AES surfactant having a molecular formula of $R^2—O—(CH_2—CH_2—O)_n—SO_3M'$, wherein $R^2$ is a $C_{10}$-$C_{20}$ alkyl group, n is 2 or 3, and M' is a monovalent cation, wherein the first AES surfactant and the second AES surfactant are combined in a weight ratio of from 0.05:1 to 1:1 to provide the liquid surfactant composition with a fresh viscosity of from about 350 cps to about 550 cps, wherein the nonionic surfactant and the anionic surfactant are present at a weight ratio of from 1:1.5 to 1:10, and wherein the liquid surfactant composition is free of a polymeric rheology modifier.

20. The method of claim 19, further comprising combining an organic solvent, a builder, an optical brightener, an opacifier, a colorant, an additional surfactant, an anti-foaming agent, an enzyme, a fragrance, a pH adjuster, a polymer, or a combination thereof with the aqueous vehicle.

* * * * *